United States Patent [19]

Ando

[11] 4,386,837

[45] Jun. 7, 1983

[54] CORONA DISCHARGING DEVICE

[75] Inventor: Yujiro Ando, Yokohama, Japan

[73] Assignee: Canon Kabushiki Kaisha, Tokyo, Japan

[21] Appl. No.: 233,873

[22] Filed: Feb. 12, 1981

Related U.S. Application Data

[62] Division of Ser. No. 97,864, Nov. 27, 1979.

[30] Foreign Application Priority Data

Dec. 7, 1978 [JP] Japan ..... 53-151812

[51] Int. Cl.[3] ..... G03G 15/02

[52] U.S. Cl. ..... 355/3 CH; 355/3 SC; 250/325

[58] Field of Search ..... 355/3 CH, 3 SC, 14 CH; 250/324–326

[56] References Cited

U.S. PATENT DOCUMENTS 4,141,648 2/1979 Gaitten et al. ..... 355/3 CH 4,168,974 9/1979 Ando et al. ..... 355/3 SC

*Primary Examiner*—R. L. Moses

*Attorney, Agent, or Firm*—Fitzpatrick, Cella, Harper & Scinto

[57] ABSTRACT

A corona discharging device in an electrophotographic apparatus used for discharging or uniformly charging the surface of a latent image bearing member. This discharging device has corona wires to which a voltage of a predetermined polarity is applied and corona wires to which a voltage of the opposite polarity to the predetermined polarity is applied, and alternately applies corona discharges to the image bearing member. Grids are provided between the corona wires and the image bearing member and a common bias voltage is applied to the grids. The final surface potential of the latent image bearing member approaches the grid bias potential.

3 Claims, 5 Drawing Figures

CORONA DISCHARGING DEVICE

This is a division of application Ser. No. 97,864, filed Nov. 27, 1979.

BACKGROUND OF THE INVENTION

1. Field of the Invention

This invention relates to a corona discharging device, and more particularly to a corona discharging device for uniformly discharging or charging the surface of an image bearing member such as a photosensitive member or an insulating member.

2. Description of the Prior Art

As an image bearing member in the ordinary electrophotographic method, there is known, in addition to a photosensitive member, an insulating member used to form a secondary latent image by an ion flow and by utilization of a latent image formed on the photosensitive member. These image bearing members are sometimes in the form of a drum or sometimes in the form of an endless web. Generally, an electrostatic latent image is formed on such image bearing member and this latent image is developed with the aid of a developer containing toner, whereafter the developed image is transferred to a transfer medium. After the image transfer, the image bearing member is cleaned by cleaning means to remove any developer remaining on the image bearing member, thus becoming ready for another cycle of image formation.

The conventional photosensitive medium can form thereon a latent image having a high electrostatic contrast of about 350–500 volts and therefore, the unevenness of some charges remaining on the photosensitive medium offers little problem. However, where the charge retaining capability of the surface of the photosensitive medium is low due to the characteristic of the surface layer or an electrostatic latent image having a high potential cannot be formed due to a special latent image formation process, if the uneven potential remaining on the photosensitive medium after the image transfer is not uniformized, it will undesirably present itself as irregularity. Particularly, an electrostatic latent image obtained by simply transferring a latent image formed on a photosensitive medium onto a latent image drum or by a process in which a secondary electrostatic latent image is formed on an insulating drum by modulating an ion flow by a primary electrostatic latent image formed on a screen-like photosensitive medium (hereinafter referred to as the screen) sometimes has an electrostatic contrast lower than 150 volts, so that the visible image resulting therefrom is disturbed by the above-described uneven potential. What is considered to be the cause of the uneven potential created on the image bearing member after the image transfer includes irregular developing effect, application of a bias voltage during the image transfer, and residue of the transferred image.

When the electrostatic contrast of the latent image formed on the image bearing member is low as described above and the image member is repetitively used, it is necessary to render the entire surface of the image bearing member to a specific uniform level.

As the means for such uniformization (usually, discharging) of the image bearing member surface, there is known the AC corona discharger. However, in the AC corona discharging, only the corona discharging action of one polarity is effectively utilized and so, a long time is required for discharging, and this cannot be said to be so suited for high-speed image formation apparatuses.

As another method, Japanese Patent Publication No. 23181/1976 discloses an example in which a voltage of the opposite polarity (for example, negative) to the residual charges is applied to a corona discharger to change an image bearing member to the saturated charge potential thereof, whereafter positive corona discharge is uniformly imparted by changing the polarity of the applied voltage to thereby render the surface potential to a desired value.

However, image bearing members which can be charged to the saturated charge potential thereof are limited and in most cases, partial dielectric breakdown occurs before the uniform saturated charge potential is reached and thus, not only potential irregularity occurs but also the image bearing member itself is often broken down. Moreover, in the above-mentioned example, it is difficult to control the final surface potential of the image bearing member always to a stable value and an inconvenience has been encountered that when images are repetitively formed, differences occur in density of the images.

Therefore, in U.S. Application Ser. No. 884,242 previously proposed by the inventor of the present application, the surface of the image bearing member is first greatly charged by positive corona, and then a negative corona discharging device having a grid is operated to uniformize and stabilize the final surface potential of the image bearing member. Also, simultaneously with the uniformization of the potential of the image bearing member, toner is charged to the same polarity as the polarity applied to the screen to thereby prevent the screen from being stained.

In this example, however, since the image bearing member is greatly charged by positive corona discharge and then the negative corona discharging device having a grid is operated to render the surface of the image bearing member to a uniform negative potential, a great deal of negative corona current flows at this time. Particularly, if the grid is provided in the discharging opening portion, much current flows through the grid to increase the overall current. Thus, particularly, ozone or other harmful substances may be created to harm the human bodies or deteriorate the insulation characteristic of the insulating layer and/or the photoconductive layer, or oxides formed in the air by ozone may undesirably corrode the metals.

SUMMARY OF THE INVENTION

It is an object of the present invention to provide a corona discharging device which is capable of uniformizing the surface potential of an image bearing member in a short time.

It is another object of the present invention to provide a corona discharging device which is capable of converging the final surface potential of an image bearing member to a stable desired value.

It is still another object of the present invention to provide a corona discharging device which minimizes the generation of ozone or other harmful substances.

The present invention which achieves these objects consists in applying a voltage of a specific polarity to the corona discharger, charging the surface of the image bearing member up to a point slightly exceeding or approximate to the potential of a grid provided in the opening portion of the corona discharger and to which a bias voltage (including the ground) is applied, then applying a voltage of the opposite polarity to said specific polarity to the discharging electrode of the corona discharger having a grid to which the same bias voltage is applied to thereby render the surface potential of the image bearing member to a uniform value. In the present invention, as the corona discharging device which achieves this, use is made of a device having a shield case, a plurality of corona wires provided in the shield case and to which voltages of different polarities are applied, and grids provided in the discharging opening portion between the respective corona wires and the image bearing member and to which a common bias voltage is applied.

Accordingly, it is possible to render the surface of the image bearing member to a stable potential in a short time and to minimize the generation of ozone to prevent any harm which would otherwise result therefrom. It is also possible to prevent the remaining toner from adversely affecting other member such as the screen.

To prevent any useless current from flowing between the corona wires in the shield case to which different voltages are applied, a partition plate may preferably be provided between the corona wire to which a positive voltage is applied and the corona wire to which a negative voltage is applied. In this sense, discrete shield cases may be provided to construct the corona discharging device of the present invention by a positive corona discharger and a negative corona discharger. The partition plate may preferably be insulative, because this will be efficient without a great deal of useless current flowing to the shield plate.

In carrying out the present invention, the spacing $d_1$ of the grid and the distance $d_2$ between the grid and the image bearing member should preferably be in the relation that $d_1/d_2=0.5-1.5$, because this is best suited to render the final surface potential of the image bearing member to the bias potential imparted to the grid.

The grid bias voltage mentioned herein includes zero potential, namely, the ground.

The above and other objects and features of the present invention will become more fully apparent from the following detailed description of the invention taken in conjunction with the accompanying drawings.

DESCRIPTION OF THE PREFERRED EMBODIMENT

Figure 1:
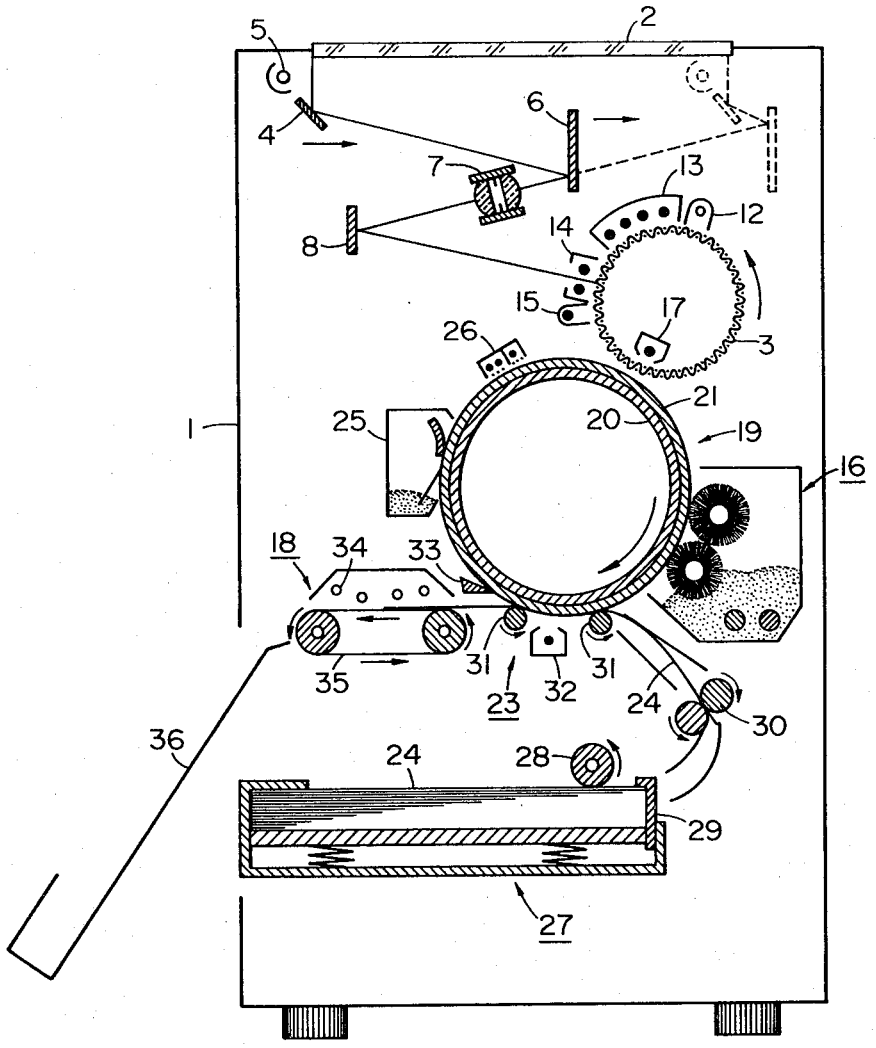
FIG. 1 is a cross-sectional view of an image formation apparatus to which the present invention is applied.

FIG. 1 is a cross-sectional view of an image formation apparatus to which the present invention is applied. The apparatus shown is a copying apparatus using a photosensitive screen having a number of fine openings and in this apparatus, ion flow is modulated to a chargeable member by a primary electrostatic latent image formed on the screen to thereby form a secondary electrostatic latent image.

In FIG. 1, reference numeral 1 designates the outer wall of the apparatus. An original such as a book or a document may be placed on an original supporting table 2 formed of a transparent material such as glass or the like on the upper portion of the outer wall 1. This original supporting table 2 is of the fixed type and the application of image light to the screen 3 is effected by movement of a part of optical means. This optical means is a conventional one, and a first mirror 4 and an original illuminating lamp 5 are moved at a velocity V along the entire stroke of the original supporting table 2 from the solid-line position to the rightmost dotted-line position. On the other hand, simultaneously with the movement of the first mirror 4 moved while scanning the surface of the original, a second mirror 6 is moved at a velocity V/2 from the solid-line position to the rightmost dotted-line position. The original image directed by the first and second mirrors 4 and 6 are further directed to the screen 3 through a lens system 7 having a diaphragm mechanism and a fixed mirror 8. The screen 3 is formed into a drum shape so that the exposed electrically conductive member thereof lies inside thereof.

Figure 2:
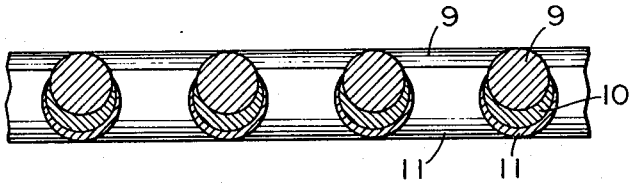
FIG. 2 is a schematic, enlarged cross-sectional view of the screen.

A schematic enlarged cross-sectional view of the screen 3 is shown in FIG. 2. In FIG. 2, the screen 3 comprises an electrically conductive member 9 having a number of fine openings such as a metal net, and a photoconductive member 10 and a surface insulating member 11 layered on the electrically conductive member 9 so that one side of the electrically conductive member is exposed. To form a primary electrostatic latent image on the screen 3, a primary voltage is applied from that side on which the surface insulating member 11 exists, and then a secondary voltage is applied simultaneously with the application of image light, and further the whole surface of the screen is uniformly exposed to light. A secondary electrostatic latent image is formed by applying a corona ion flow from that side of the screen on which the electrically conductive member 9 is exposed, modulating the corona ion flow by the primary latent image and causing the modulated ion flow to be retained on the chargeable member. The details of this latent image formation process are described in aforementioned U.S. Application Ser. No. 884,242 and so, detailed description thereof is omitted herein.

In the copying apparatus of this embodiment, latent image formation means are disposed adjacent to and along the direction of rotation of the screen 3. Designated by 12 in FIG. 1 is a pre-exposure lamp for enabling the photoconductive member forming the screen 3 to be always used in stable light history conditions. Denoted by 13 is a corona discharger which is primary voltage applying means for charging the rotating screen 3 to a sufficient potential for latent image formation. Designated by 14 is a corona discharger which is secondary voltage applying means for removing the charge on the screen 3 imparted by the discharger 13. Simultaneously therewith, the original image is projected upon the screen 3. Therefore, the discharger 14 is of a construction in which the back side shield plate thereof is optically opened. Denoted by 15 is a whole surface illuminating lamp for uniformly illuminating the screen 3 to rapidly enhance the electrostatic contrast of the primary electrostatic latent image.

By the above-described means, a primary electrostatic latent image with high electrostatic contrast is formed on the screen 3. A secondary electrostatic latent image is formed on an insulating drum 19 by a discharger 17, the insulating drum 19 being a recording medium rotated in the direction of arrow. The insulating drum 19 comprises an insulating layer 21 covering a photoconductive back-up member 20, and a voltage is applied between the photoconductive back-up member and the conductive member of the screen 3 to direct the modulated corona ion to the surface of the insulating layer 21.

The secondary electrostatic latent image so formed on the insulating layer 21 is developed into a toner image by conventional developing means 16. Thereafter, at a station 23, the toner image is transferred to a transfer medium 24 conveyed thereto in sychronism with the toner image. After the image transfer, the insulating drum 19 is cleaned by cleaning means to remove any remaining toner on the insulating layer 21, and is rendered to a uniform surface potential by the corona discharging device 26 of the present invention, thus becoming ready for another cycle of copying. On the other hand, transfer mediums 24 to be conveyed to the image transfer station 23 are piled in a cassette 27 and are separated one by one by a feed roller 28 and separating pawl 29 and conveyed by register rollers 30 in correspondence with the toner image position. Designated by 31 is a transport roller and denoted by 32 is an image transfer corona discharger for applying a bias voltage to the transfer medium 24 during the transfer of the toner image. After the image transfer, the transfer medium 24 is separated from the insulating drum 19 by a separating pawl 33 and conveyed to fixing means 18. The transfer medium 24 having the toner image thereon fixed by a heater 34 is conveyed into a finished transfer medium containing tray 36 by a conveyor belt 35. Where retention copying is effected, only those of the above-described steps which are subsequent to the secondary electrostatic latent image formation may be repeated, thus enabling copying at high speed.

Figure 3:
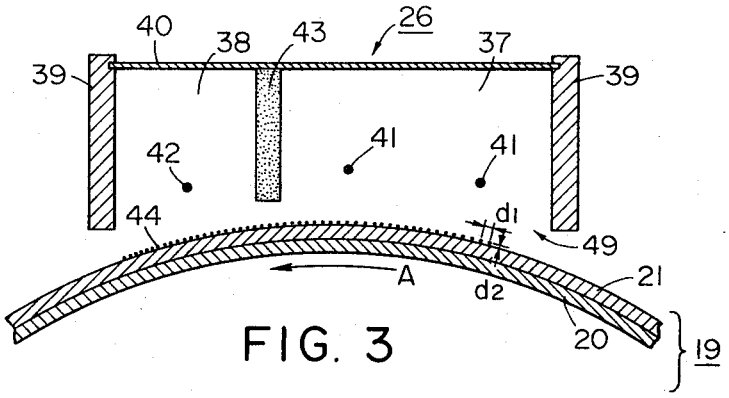

The corona discharging device 26 located above the cleaning means 25 is the discharging device of the present invention for uniformizing the surface potential of the image bearing member. FIG. 3 shows a cross-section of the corona discharging device 26 in the copying apparatus shown in FIG. 1. Designated by 19 in FIG. 3 is the insulating drum comprising an electrically conductive back-up member 20 and an insulating layer 21 and rotatable in the direction of arrow A. The corona discharging device 26 is divided into two corona discharging portions 37 and 38, and comprises a shield case consisting of a side shield plate 39 and a back side shield plate 40, corona wires 41 provided in the corona discharging portion 37, a corona wire 42 provided in the discharging portion 38, a partition plate 43 partitioning the discharging device into the two discharging portions, and a grid 44 provided so as to cover substantially the entire area of the discharge opening. A positive high voltage is applied to the wire 41 in the larger corona discharging portion 37, and a negative high voltage is applied to the wire 42 in the smaller discharging portion 38. On the other hand, the grid 44 is connected to a bias voltage source (not shown).

Before the insulating drum 19 comes to the corona discharging device 26, the surface potential thereof is at a negative value with respect to the voltage applied to the grid 44. Conversely, if the surface potential is positive, the discharging portions 37 and 38 are changed in place or the polarity of the voltage applied to the corona wires is reversed.

In the case of the present embodiment, the surface potential of the insulating drum 19 is rendered to a positive value with respect to the potential of the grid by the action of the positive corona discharge of the corona discharging portion 37. This is because if the corona discharge is discontinued before the surface potential reaches the grid potential, the effect of uniformizing the uneven surface potential of the insulating drum is reduced and because if the surface potential is a negative potential with respect to the potential of the grid, the next negative corona current does not flow to the insulating drum and thereby nulls the effect of uniformizing the potential by the negative corona discharge. Of course, even if the surface potential is imparted only to a value somewhat lower than the grid potential by positive corona discharge, it will be enough if the next negative corona current flows to the insulating drum to vary the surface potential by a necessary amount and therefore, depending on the intensity of the negative corona discharge, even such a condition may be preferred embodiment.

How much the surface potential deviates toward a positive value with respect to the grid potential depends on the configuration of the corona wires, the distance to the insulating drum, the applied voltage, the electrostatic capacity of the insulating drum, etc., but the factors which most affect the surface potential are the spacing $d_1$ between the grid elements and the distance $d_2$ from the insulating drum. As the distance $d_2$ is smaller, the charging speed is increased to enhance the efficiency. However, in view of the reasons such as prevention of contact between the grid and the insulating drum and prevention of the grid elements from being stained by toner, about 1 mm may be said to be the possible minimum value of $d_2$ in the actual copying apparatus. It has also been empirically ascertained that a wider spacing $d_1$ between the grid elements generally results in an increased charging speed but this encounters a difficulty in converging the surface to the grid potential, while if the spacing is narrow, the surface potential is uniformized by the grid potential but the charging speed is slowed down.

On the other hand, the value at which the potential is saturated is determined by the ratio of $d_1$ to $d_2$. If $d_1$ is sufficiently smaller than $d_2$, the potential will be saturated by the voltage applied to the grid and however intensified the corona discharge is, the surface potential will not assume a positive value with respect to the grid potential. As $d_1$ becomes greater, the potential of the insulating drum comes to be converged at a positive value with respect to the voltage applied to the grid.

Subsequently, the insulating drum is rendered to a predetermined negative potential with respect to the grid voltage by the negative corona current of the corona discharging portion 38. By this, any slight unevenness remaining in the surface potential due to the positive charging previously effected can be uniformized and the final surface potential can also be always brought to a stable value. Thus, in the case of an apparatus in which the electrostatic contrast is not so high like the aforementioned copying apparatus using the screen, the present invention is particularly effective to prevent disturbance of the image. Moreover, not so much corona discharge current is required from the point whereat the surface potential slightly exceeds the grid potential to the point whereat the surface potential is converged to the final potential and thus, creation of ozone can be prevented.

As already described, in order to provide positive and negative corona discharges through the grid to which the same voltage has been applied and thereby uniformize the surface potential of the insulting drum, it is desirable to pass the grid potential by corona discharge of a first polarity and charge the surface of the insulating drum to the opposite potential in the manner described above. When an experiment was carried out by using a grid comprising metal wires having a diameter of 0.1 mm and stretched equidistantly and by providing a spacing of 1 mm between the grid and the insulating drum surface, the amount of deviation of the saturation potential of the drum surface from the grid potential was 10–20 V for the grid spacing of 0.2 mm, 50–60 V for the grid spacing of 0.5 mm, 100–200 V for the grid spacing of 1 mm, and 150–400 V for the grid spacing of 1.5 mm. Incidentally, the voltages applied to the corona wires in this case were +7.5 KV to the positive corona wire and −7.0 KV to the negative corona wire, and the grid bias voltage $V_G$ was +130 V. The voltages applied to the electrodes may be 6–8 KV and the grid bias voltage $V_G$ may be 0–±300 V. When $V_G$=OV, substantially grounded condition is exhibited and the insulating drum is discharged to zero potential.

From this result, it has become clear that when the grid spacing is less than 0.5 mm, the surface potential does not exceed (reverse) the grid potential and even if the corona discharge is intensified, it is unsuitable in that the value reversed by positive and negative corona discharges is too small and moreover the charging speed is slow, and that when the grid spacing is greater than 1.5 mm, the potential becomes difficult to saturate and insufficient control occurs to aggravate the stability of the surface potential of the insulting drum.

That is, in the present invention, the most remarkable operational effect can be obtained when the ratio of the grid spacing $d_1$ to the distance $d_2$ between the grid and the insulating drum is in the relation that $d_1/d_2=0.5–1.5$.

Figure 4:
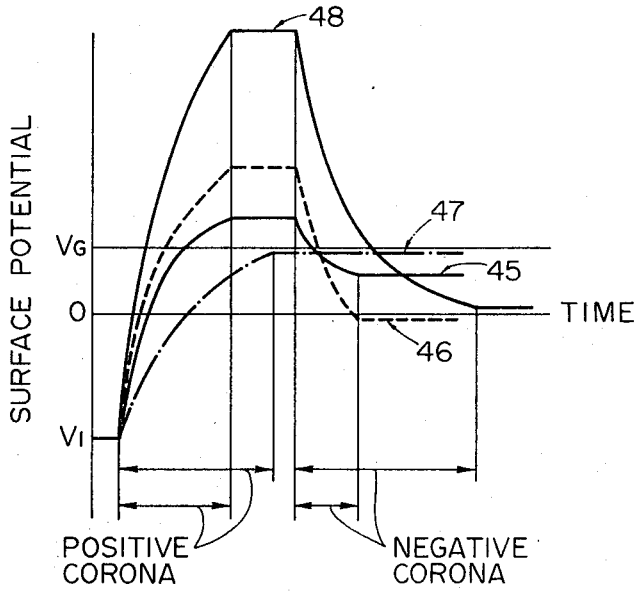
FIG. 4 is a graph of the surface potentials of the insulating drum resulting from differences in grid spacing.

FIG. 4 graphically illustrates the above-described result. In FIG. 4, reference numeral 45 shows the surface potential curve when the grid spacing is proper, broken line 46 refers to the case where the grid spacing is too wide, ad dot-and-dash line 47 refers to the case where the grid spacing is too narrow. Solid line 48 shows the potential curve when no grid is provided in the opening during the positive corona discharging of the corona discharging portion 37 of FIG. 3 (or when, even if the grid is provided, no bias voltage is applied to the grid in this portion but the grid is electrically floated), and as seen, the surface potential of the insulating drum is greatly reversed from its initial residual potential $V_1$ to the opposite polarity, whereafter the surface potential is converged to the vicinity of the grid potential by a negative corona discharger having a grid. However, in case of this dishcarging device, a great deal of negative corona current must be flowed to provide a uniform surface potential and this is not desirable when the counter-measure for ozone is taken into account.

In FIG. 3, the grid is not stretched in the fore end portion (shown at 49) of the corona discharger so that part of corona ions may reach the surface of the insulating drum not through the grid. This is because such arrangement is effective to quickly vary the potential although the potential control effect is small in this portion. The grid spacing and the distance to the insulating drum need not always be constant, but of course they may be partly varied. Also, to reduce the overall corona current value, such known means as making the shield plates 39, 40 of the corona discharging device insulative and making only the end of the opening portion of the shield conductive may be applied.

In the above-described embodiment, the back side shield 40 is electrically conductive but reduces the discharging current by providing a great distance between the shield 40 and the corona wires. If the partition plate 43 between the corona discharging portions 37 and 38 is formed of an insulating material, it will be effective to prevent excessive flow of the discharging current due to the great potential gradient between the corona wires 41 and 42 to which voltage of the opposite polarities are applied. Of course, the partition plate 43 may be electrically conductive.

In the present embodiment, the balance with respect to the generation and reduction of the corona current is provided by making the partition plate 43 insulative and making the shield plates 41, 42 electrically conductive. This is because, if the entire shield is made insulative, the corona current will become least but corona discharge will become difficult to take place and the necessary voltage applied to the corona wires will become increased, thus making the power source device undesirably bulky. Particularly, in the case of a corona discharging device using a grid, there is a phenomenon that as the applied voltage is lower, the rate at which corona current passes through the grid is increased and in this sense, it is preferable to make small the electric field on that side of the corona wire which is adjacent to the grid.

In this embodiment, a plurality of corona wires 41 are disposed in the positive corona discharging portion 37 and a single corona wire 42 is provided in the negative corona discharging portion 38, but whether there is a single corona wire or a plurality of corona wires leads to little or no difference in effect. If remotely spoken, provision of more corona wires reduces the time required for the charging (or the discharging). However, an increased number of negative corona wires would cause generation of more ozone and therefore, a smallest possible number of negative corona wires is preferred.

As is apparent from FIG. 4, the surface potential of the insulating drum after having passed the discharging device can be freely varied by the voltage $V_G$ applied to the grid and so, it is possible to select the value of $V_G$ so that the surface potential becomes a necessary potential in accordance with how the insulating drum or the photosensitive medium is utilized thereafter. Where this corona discharging device is applied to the insulting drum of a copying apparatus using the above-described screen, $V_G$ is usually selected to the order of +100 -200 V. By doing so, in spite of the fact that the potential of the insulating drum after having passed the corona discharging device is of the positive polarity, the toner charger remaining on this drum is intensely affected by the corona discharge of the negative polarity to which the drum is lastly subjected, thus assuming the negative polarity or a value approximate to zero. Accordingly, there is no possibility that toner is scattered onto the screen to which a negative voltage is being applied, to thereby contaminate the screen.

Figure 5:
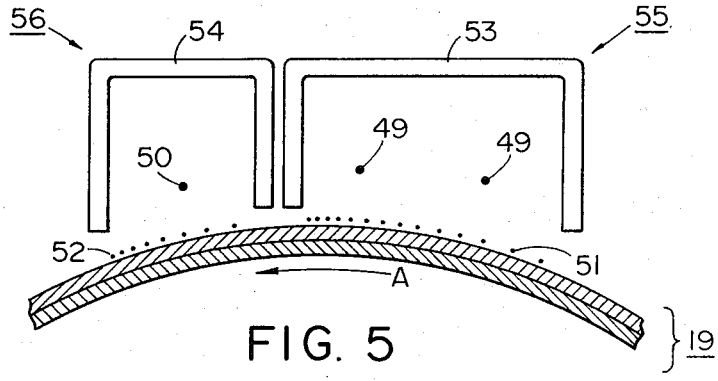
FIG. 5 is a cross-sectional view of the corona discharging device according to another embodiment of the present invention.

An example in which two corona discharging portions of different polarities are provided in a single corona discharging device has been shown in FIG. 3, but a construction as shown in FIG. 5 may be adopted in which corona dischargers 55 and 56 having separate shield cases 53 and 54 containing therein corona wires 49 and 50 to which voltages of different polarities are applied and grids 51 and 52 to which the same bias voltage is applied are arranged in the same order as the embodiment of FIG. 3 with respect to the direction of movement of the insulating drum 19.

Also, as shown in FIG. 5, the spacings of the grids 51 and 52 may be made gradually closer in the direction of movement A of the insulating drum 19. As already noted, this will make the charging (discharging) speed faster in the portion wherein the grid spacings are wider and will be effective to uniformize the potential in the portion wherein the spacings are narrower.

In the foregoing description of the embodiment, an example in which the corona discharging device of the present invention is applied for uniform charging (discharging) of the insulating drum has been shown, but the corona discharging device of the present invention is also applicable for discharging a photosensitive screen or a conventional photosensitive medium. AC corona discharge is usually used for discharging of such photosensitive medium, but the corona discharging device of the present invention enables uniform discharging to be accomplished in a shorter time than AC corona discharge. This is because AC corona discharge is effective only when the polarity of the applied voltage thereof is opposite to the polarity of the residual charge on the surface of the photosensitive medium and moreover, when the polarity is varied, no discharge takes place and discharging requires a long time. The present invention solves such problem. Also, where light is applied simultaneously with discharging, the back side shield 40 of FIG. 3 may be removed or a construction in which the back side shield is optically opened by a member such as Nesa glass or the like may be adopted. Also, by making the value of the grid bias $V_G$ variable and suitably selecting this value, the discharging device of the present invention can be used as the discharging device for uniformly charging the photosensitive medium. In this case, the discharging device itself has the function of uniformizing the surface potential of the photosensitive medium and it is therefore effective in that the necessity of providing a special deelectrifying device is elminated.

As described above in detail, according to the present invention, positive and negative corona ions are successively imparted to the image bearing member through the grid to which a bias voltage is applied and therefore, the surface of the image bearing member can be rendered to a stable potential in a short time and moreover, generation of ozone is minimized to prevent the harm of ozone. Also, at whatever positive or negative potential the surface of the image bearing member may be, it is possible to converge such potential to a predetermined potential.

In the case of the corona discharging device of the present invention having a plurality of corona wires to which voltages of different polarities are applied, by suitably selecting the grid spacings, the grid can be commonly used for both the positive and negative corona discharging portions and this eliminates the necessity of separately providing means for stretching the grids and means for positioning the grids, and a common voltage source for the grids can effectively be used.

What we claim is:

1. An image forming apparatus, comprising:

a photosensitive screen having a number of fine openings;

means for forming a primary electrostatic latent image on said photosensitive screen, wherein said screen is relatively movable with respect to said image forming means;

an image bearing member;

means disposed at a modulating station for applying a flow of ions through said screen, wherein the screen modulates the flow of ions in accordance with the primary latent image, to form a secondary electrostatic latent image on said image bearing member;

means, at a developing station, for developing the secondary electrostatic latent image;

means, at a transferring station, for transferring the developed image onto a transfer material; and a corona discharging device for uniformly charging or discharging the surface of said image bearing member, said corona device being disposed in a faced relation with said image bearing member and downstream of said transfer station but upstream of said modulating station, and said corona device including two shield cases disposed side-by-side along the direction of said movement, with at least one corona wire provided in each of said shield cases, wherein a voltage of a first polarity and a voltage of the opposite polarity to said first polarity are applied respectively to said wires, said corona device further including grid means provided between each of said wires of the respective shield cases and said image bearing member, wherein a common bias voltage is applied to said grid means, wherein the spacing $d_1$ between wires of said grid means and the distance $d_2$ between the grid means and said image bearing member are in the relation that $d_1/d_2=0.5-1.5$, and wherein said grid means is mounted to be spaced away from a front end of the discharging opening of the upstream one of said shield cases.

2. An image forming apparatus comprising:

a photosenstive screen having a number of fine openings;

means for forming a primary electrostatic latent image on said photosensitive screen, wherein said screen is relatively movable with respect to said image forming means;

an image bearing member;

means disposed at a modulating station for applying a flow of ions through said screen, wherein said screen modulates the flow of ions in accordance with the primary latent image to form a secondary electrostatic latent image on said image bearing member;

means, at a developing station, for developing the secondary electrostatic latent image;

means, at a transferring station, for transferring the developed image onto a transfer material; and a corona discharging device for uniformly charging or discharging the surface of said image bearing member, said corona device being disposed in a faced relation with said image bearing member and downstream of said transfer station but upstream of said modulating station, and said corona device including two shields cases disposed side-by-side along the direction of said movement, with at least one corona wire provided in each of said shield cases, wherein a voltage of a first polarity and a voltage of the opposite polarity to said first polarity are applied respectively to said wires, said corona device further including grid means provided between each of said wires of the respective shield cases and said image bearing member, wherein a common bias voltage is applied to said grid means, and wherein the grid wire spacings of said grid means are gradually closer in the direction of movement of said image bearing member.

3. An image formation apparatus, comprising:

a photosensitive screen having a number of fine openings;

means for forming a primary electrostatic latent image on said photosensitive screen, wherein said screen is relatively movable with respect to said image forming means;

an image bearing member;

means disposed at a modulating station for applying a flow of ions through said screen, wherein said screen modulates the flow of ions in accordance with the primary latent image to form a secondary electrostatic latent image on said image bearing member;

means, at a developing station, for developing the secondary electrostatic latent image;

means, at a transferring station, for transferring the developed image onto a transfer material; and a corona discharging device for uniformly charging or discharging the surface of said image bearing member, sai corona device being disposed in a faced relation with said image bearing member and downstream of said transfer station but upstream of said modulating station, and said corona device including two shields cases disposed side-by-side along the direction of said movement, with at least one corona wire provided in each of said shield cases, wherein a voltage of a first polarity and a voltage of the opposite polarity to said first polarity are applied respectively to said wires, said corona device further including grid means provided between each of said wires of the respective shield cases and said image bearing member, wherein a common bias voltage is applied to said grid means, and wherein said corona discharging device comprises means for charging or discharging a residual toner so as to prevent the residual toner from being urged toward said photosensitive screen by an electric field at the time of ion modulation, thereby preventing the residual toner from being deposited on the photosensitive screen.

* * * * *

UNITED STATES PATENT AND TRADEMARK OFFICE

CERTIFICATE OF CORRECTION

PATENT NO. : 4, 386,837

DATED : June 7, 1983

INVENTOR(S) : YUJIRO ANDO

It is certified that error appears in the above—identified patent and that said Letters Patent is hereby corrected as shown below:

Col. 1, line 43, insert --an-- between "as" and "irregularity";

line 61, insert --bearing-- between "image" and "member".

Col. 2, line 20, delete "always".

Col. 3, line 19, change "member" to --members--;

before line 50, insert the following paragraph:

-- Fig. 3 is a cross-sectional view of the corona discharging device according to one embodiment of the present invention.--

Col. 6, line 17, insert --a-- between "be" and "preferred".

Col. 7, line 40, change "ad" to --and--.

Col. 9, line 42, change "elminated" to --eliminated--.

UNITED STATES PATENT AND TRADEMARK OFFICE

CERTIFICATE OF CORRECTION

PATENT NO. : 4,386,837

DATED : June 7, 1983

INVENTOR(S) : YUJIRO ANDO

It is certified that error appears in the above-identified patent and that said Letters Patent is hereby corrected as shown below:

Col. 12, line 5, change "sai" to --said--;

line 9, change "shields" to --shield--.

Signed and Sealed this

*Tenth* Day of *April 1984*

[SEAL]

*Attest:*

GERALD J. MOSSINGHOFF

*Attesting Officer*

*Commissioner of Patents and Trademarks*